US010361041B2

(12) United States Patent
Mantua et al.

(10) Patent No.: US 10,361,041 B2
(45) Date of Patent: Jul. 23, 2019

(54) EMERGENCY STOP MECHANISM FOR CABLE-PULL SAFETY SWITCH

(71) Applicant: Honeywell International Inc., Morris Plains, NJ (US)

(72) Inventors: Mark A. Mantua, Freeport, IL (US); Steven Speece, Winnebago, IL (US)

(73) Assignee: Honeywell International Inc., Morris Plains, NJ (US)

( * ) Notice: Subject to any disclaimer, the term of this patent is extended or adjusted under 35 U.S.C. 154(b) by 23 days.

(21) Appl. No.: 15/446,721

(22) Filed: Mar. 1, 2017

(65) Prior Publication Data

US 2018/0240619 A1 Aug. 23, 2018

Related U.S. Application Data

(60) Provisional application No. 62/462,634, filed on Feb. 23, 2017.

(51) Int. Cl.
*H01H 3/02* (2006.01)
*H01H 3/42* (2006.01)

(52) U.S. Cl.
CPC ..... *H01H 3/0226* (2013.01); *H01H 3/022* (2013.01); *H01H 3/42* (2013.01); *H01H 2003/0246* (2013.01)

(58) Field of Classification Search
CPC .... H01H 3/022; H01H 3/42; H01H 2003/024; H01H 2003/0246; H01H 3/0226
See application file for complete search history.

(56) References Cited

U.S. PATENT DOCUMENTS 3,192,334 A * 6/1965 Dimond ..... H01H 9/22 200/50.12
4,107,490 A * 8/1978 Keane ..... A47C 21/006 200/52 R
4,114,001 A * 9/1978 Corfield ..... F16P 3/08 200/336
4,182,943 A * 1/1980 Butterworth ..... H01H 3/022 200/318.2
5,821,488 A * 10/1998 Falcon ..... H01H 3/0226 200/52 R
6,365,850 B1 * 4/2002 Arnold ..... H01H 3/0226 200/17 R
7,022,930 B2 * 4/2006 Hall ..... H01H 3/0226 200/334
8,089,012 B2 1/2012 Mohtasham et al.
8,957,338 B2 * 2/2015 Li ..... H01H 3/022 200/345

FOREIGN PATENT DOCUMENTS

KR 946551 B1 12/2016

* cited by examiner

*Primary Examiner* — Felix O Figueroa
(74) *Attorney, Agent, or Firm* — Craige Thompson; Thompson Patent Law

(57) ABSTRACT

A safety switch is disclosed herein. The safety switch may comprise: a housing, wherein the housing comprises a mating cam; a face plate, wherein the face plate is coupled to the housing; and a subassembly coupled to the face plate, wherein the subassembly comprises: a base, wherein the base comprises a slot; a cam, wherein the cam is positioned within the base; a pushbutton, wherein the pushbutton comprises a hole; and a pin positioned through the hole of the pushbutton and the slot of the base; wherein the cam, the base, and the pushbutton are mated together with the pin; wherein the subassembly is not rotatable due to the pin.

13 Claims, 6 Drawing Sheets

EMERGENCY STOP MECHANISM FOR CABLE-PULL SAFETY SWITCH

CROSS-REFERENCE TO RELATED APPLICATIONS

This application claims priority to U.S. Provisional Patent Application Ser. No. 62/462,634 entitled "Emergency Stop Button For Cable-Pull Safety Switch" filed Feb. 23, 2017, which is incorporated herein by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Safety switches may be utilized in applications where an emergency stop capability may be needed over an extended distance. Accordingly, a cable may be disposed in tension in close proximity to a machine, such as, for example, a conveyor system. The cable may be operatively connected to a safety switch which may be operatively coupled to the machine. Actuating the safety switch or pulling the cable may terminate power to the machine.

SUMMARY

In an embodiment, a safety switch may comprise: a housing, wherein the housing comprises a mating cam; a face plate, wherein the face plate is coupled to the housing; and a subassembly coupled to the face plate, wherein the subassembly comprises: a base, wherein the base comprises a slot; a cam, wherein the cam is positioned within the base; a pushbutton, wherein the pushbutton comprises a hole; and a pin positioned through the hole of the pushbutton and the slot of the base; wherein the cam, the base, and the pushbutton are mated together with the pin; wherein the subassembly is not rotatable due to the pin.

In an embodiment, a safety switch may comprise: a subassembly, wherein the subassembly comprises: a base, wherein the base comprises a slot; a cam, wherein the cam is positioned within the base; a pushbutton, wherein the pushbutton comprises a hole; a spring, wherein the spring is positioned between the base and the pushbutton; and a pin positioned through the hole of the pushbutton and the slot of the base; wherein the cam, the base, and the pushbutton are mated together with the pin; wherein the subassembly is not rotatable due to the pin.

In an embodiment, a method for operating a safety switch for a cable-pull mechanism may comprise: depressing a pushbutton with a linear force on an emergency stop mechanism of the cable-pull mechanism; moving a cam towards a mating cam, wherein the cam comprises protrusions, wherein the mating cam comprises angular surfaces; contacting the angular surfaces of the mating cam with the protrusions of the cam; sliding the protrusions against the angular surfaces; rotating the mating cam; and terminating power to a machine.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
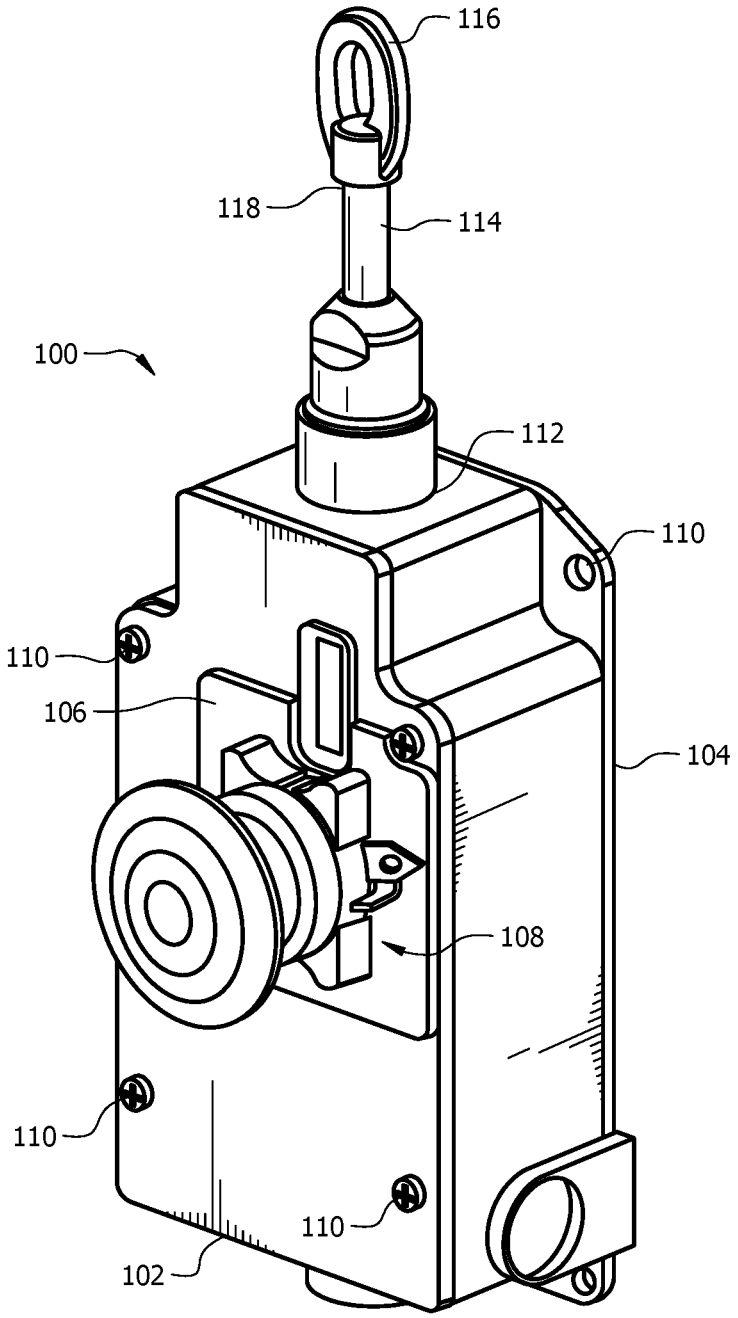
FIG. 1 is a schematic illustration of E-stop Pushbutton Safety Switch in accordance with embodiments of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure may include emergency stop button (or E-stop button) mechanisms for use with a cable-pull safety switch. Embodiments may add an emergency stop button to the cable pull safety switch that may transfer the same contacts that change state on actuation of the cable pull shaft. The cable pull device may use a rotary knob including a manual interface to reset the contacts after actuation. The disclosed embodiments may replace the rotary reset knob with a button mechanism that may include a linear force to act on it, depressing the button. The reset function may be performed by a lever under the emergency stop button that works independently of the emergency stop button.

If the need occurs to actuate a cable pull safety switch while directly in front of the switching device, it may be advantageous to have an emergency stop button on the switching device. Due to the unlimited mounting orientations of the cable pull safety switch, the addition of multiple switch-reset features, as well as multiple switch position indicators, may increase the ease of the switch operation for the user.

The linear force that depresses the emergency stop button may be converted to rotary motion on the mechanism using angular cam surfaces, rotating the reset mechanism. Embodiments may allow for the addition of the emergency stop button with minimal product design modifications.

The addition of the emergency stop button may increase the safety coverage zone in a cable pull application. The emergency stop button sub-assembly may be attached to the product cover, interfacing with the switch reset mechanism using cam surfaces that may convert linear motion to rotary motion. The reset mechanism may have multiple user interface positions as well as multiple switch position indication features to improve the switches ease of use. The emergency stop sub-assembly components may be manufactured from polymer materials, metallic materials, and/or a combination of the two.

The emergency button may be keyed to the product cover/enclosure to prevent rotation. The button/button subassembly may have features that interface with a cam that may be linked to the reset mechanism on depression of the button, causing the cam to rotate, changing the state of the switch electrical contacts. The cam may also be rotated independent of the emergency stop button with a lever to reset the switch on actuation of the cable pull or depression of the emergency stop button.

The cam features may convert a linear force to rotary motion. A pin may ride in a slot to keep the cam from rotating. The mating cam may rotate to actuate a snap action mechanism of the switch. The snap action mechanism may be part of the current product. The reset lever may be actuated from either side of the button.

The disclosure may relate to a safety switch with a pushbutton electronic stop ("E-stop Pushbutton Safety Switch"). Specifically, embodiments of the disclosure may relate to converting a linear force that depresses an emergency stop button to a rotary motion on a device by utilizing angular cam surfaces which may rotate a power control mechanism, thereby terminating power to a machine. This design may allow for an addition of an emergency stop button with minimal product design modifications, and may increase the safety coverage in a cable pull application. Additionally, operational ease for a user of the E-stop Pushbutton Safety Switch may be increased due to its unlimited mounting orientations, multiple switch reset features, and multiple switch position indicators.

FIG. 1 is a schematic illustration of E-stop Pushbutton Safety Switch 100. E-stop Pushbutton Safety Switch 100 may be operatively (e.g., electrically and/or mechanically) coupled to a machine (e.g., a conveyor system, etc.). E-stop Pushbutton Safety Switch 100 may include face plate 102, housing 104, spacer plate 106, and subassembly 108. All of the aforementioned components of E-stop Pushbutton Safety Switch 100 may be made from any suitable material, such as, for example, polymer materials, metallic materials or combinations thereof.

Face plate 102 may be attached to housing 104 by any suitable means, such as, for example, screws 110, bolts, adhesive, welds, or combinations thereof. Spacer plate 106 may be coupled to face plate 102 by any suitable means, such as, for example, adhesive, welds, screws 111, bolts or combinations thereof. Subassembly 108 may be coupled to spacer plate 106 by any suitable means, such as, for example, adhesive, welds, screws, bolts or combinations thereof.

Housing 104 may include shaft 114 extending from top surface 112 of housing 104. Shaft 114 may include eyebolt 116 or other coupling mechanism at distal end 118 of shaft 114. A cable may be inserted through eyebolt 116 and extend along a perimeter of a machine.

Figure 2:
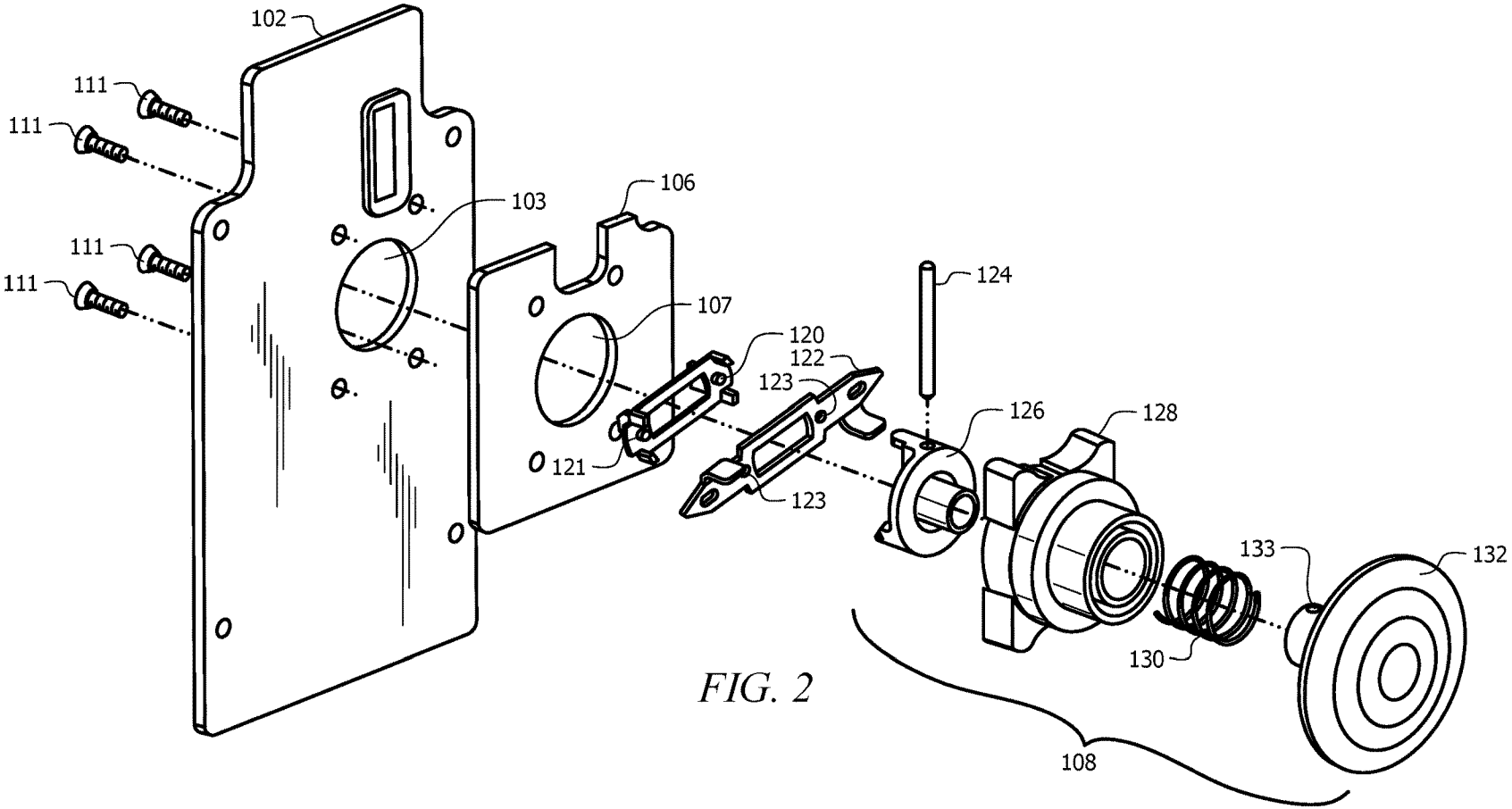
FIG. 2 is a schematic illustration of a subassembly of an E-stop Pushbutton Safety Switch in accordance with embodiments of the disclosure.

E-stop Pushbutton Safety Switch 100 may further include retainer 120 and lever 122, as shown on FIG. 2. Face plate 102 may include void 103. Spacer plate 106 may include void 107. FIG. 2 also illustrates components of subassembly 108. Subassembly 108 may include pin 124, cam 126, base 128, spring 130 and pushbutton 132. Retainer 120 may be fitted into the center of void 107 and may be configured to position lever 122 in the center of void 107, void 103 and base 128. Voids 103 and 107 may allow cam 126 to contact mating cam 138 (shown on FIG. 5). Protrusions 121 of retainer 120 may be press/friction fitted into holes 123 of lever 122. Spring 130 may be positioned within base 128 and extend between base 128 and pushbutton 132, thereby biasing pushbutton 132 away from base 128. Base 128 may include a cavity (cavity 136 shown on FIG. 3), thereby allowing cam 126 to be positioned or disposed within base 128. Cam 126 may also be positioned to contact lever 122. Pin 124 may be inserted through slot 129 (shown on FIG. 3) of base 128 and hole 133 of pushbutton 132, thereby mating cam 126, base 128 and pushbutton 132 together. Pin 124 may hold cam 126 within cavity 136 (shown on FIG. 3) of base 128. Pin 124 may be keyed to base 128 and may not allow subassembly 108 to rotate. Pin 124 may be of an elongated cylindrical shape. The pushbutton 132 may be keyed to face plate 102 to prevent rotation of pushbutton 132.

Figure 3:
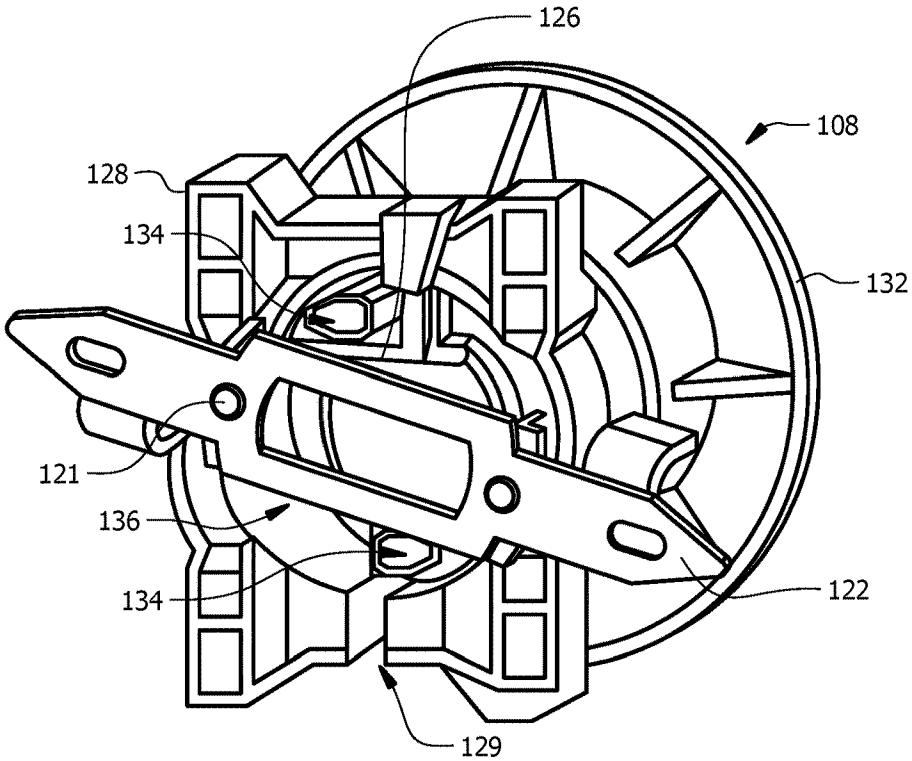
FIG. 3 is a schematic illustration of the backside of a subassembly of an E-stop Pushbutton Safety Switch in accordance with embodiments of the disclosure.

FIG. 3 illustrates a backside view of subassembly 108. As described above, lever 122 may be pressure/friction fitted into retainer 120 by inserting protrusions 121 of retainer 120 into holes 123 of lever 122 (shown on FIG. 2). Cam 126 may be positioned within cavity 136 of base 128. Cam 126 may include protrusions 134 which may contact angular surfaces 140 (shown on FIG. 5) of mating cam 138 (shown on FIG. 5). Pin 124 (shown on FIG. 2) may be positioned within slot 129 between protrusions 134. Cam 126 with protrusions 134 and mating cam 138 with angular surfaces 140 may be configured to convert linear motion (e.g., depressing pushbutton 132) into rotary motion (e.g., rotating mating cam 138).

Figure 4:
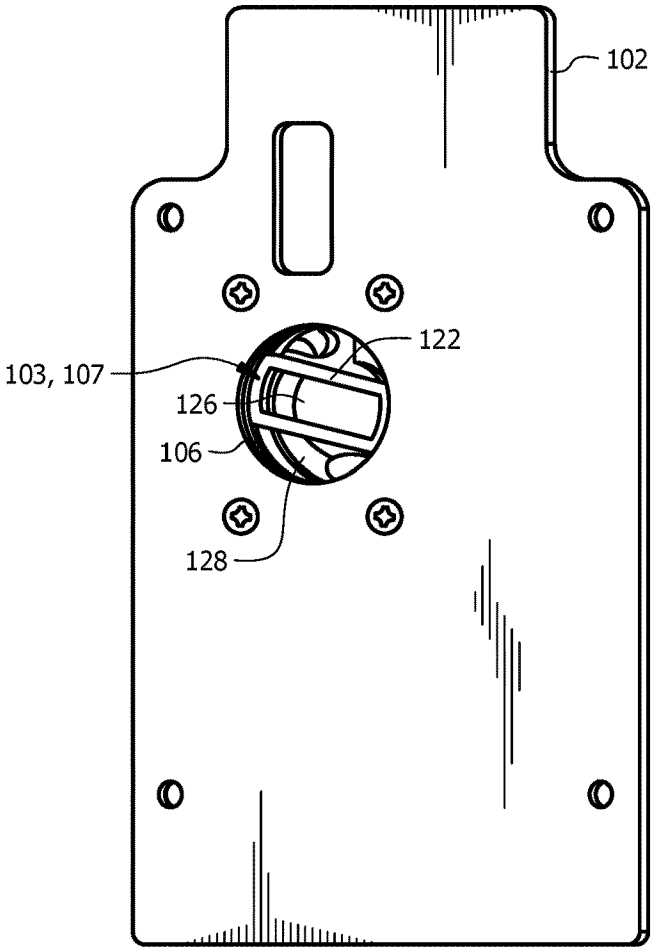
FIG. 4 is a schematic illustration of the backside of a subassembly of an E-stop Pushbutton Safety Switch from inside of a face plate in accordance with embodiments of the disclosure.

FIG. 4 illustrates a view of subassembly 108 from the inside of face plate 102. As shown, subassembly 108 may be positioned within the center of void 103 (also shown on FIG. 2) of face plate 102 and the center of void 107 (also shown on FIG. 2) of spacer plate 106. These voids 103 and 107 may allow cam 126 to contact and rotate mating cam 138 (shown on FIG. 5) upon depressing pushbutton 132.

Figure 5:
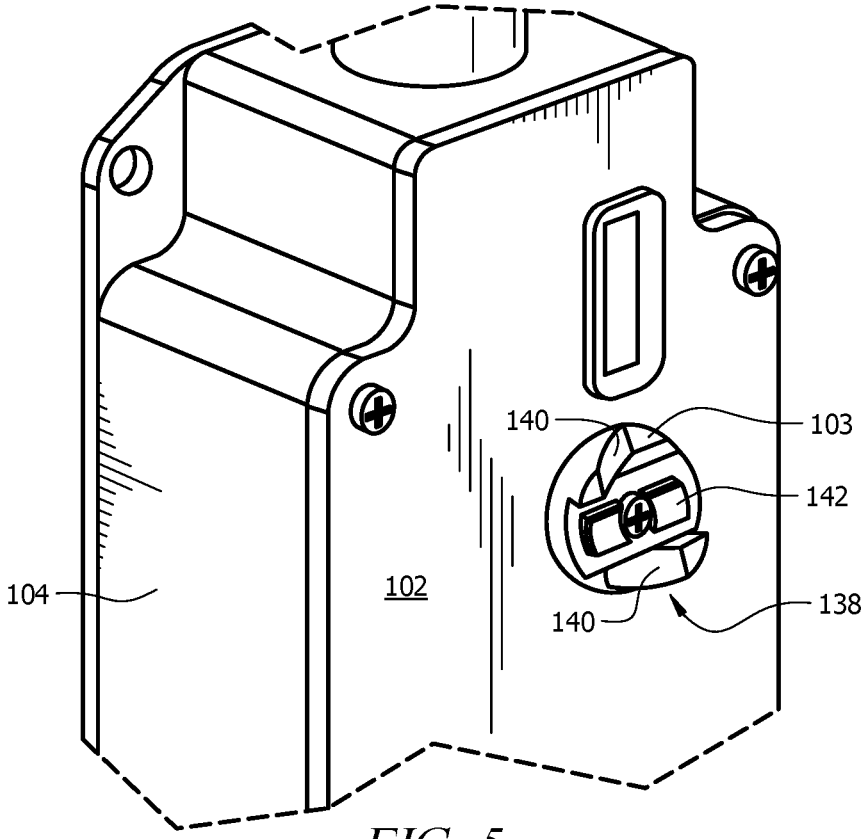
FIG. 5 is a schematic illustration of a mating cam of an E-stop Pushbutton Safety Switch in accordance with embodiments of the disclosure.

FIG. 5 illustrates mating cam 138 which may include angular surfaces 140. Mating cam 138 may be positioned within housing 104 and may extend outwards from face plate 102 through void 103. Mating cam 138 may include raised portion 142 which may allow retainer 120 and lever 122 to be seated onto mating cam 138. Thus, the rotation of mating cam 138, retainer 120 and lever 122 is synchronous. It should be noted that although mating cam 138, retainer 120 and lever 122 may rotate; subassembly 108 (shown on FIG. 3) may not rotate due to pin 124 (shown on FIG. 2).

Figure 6:
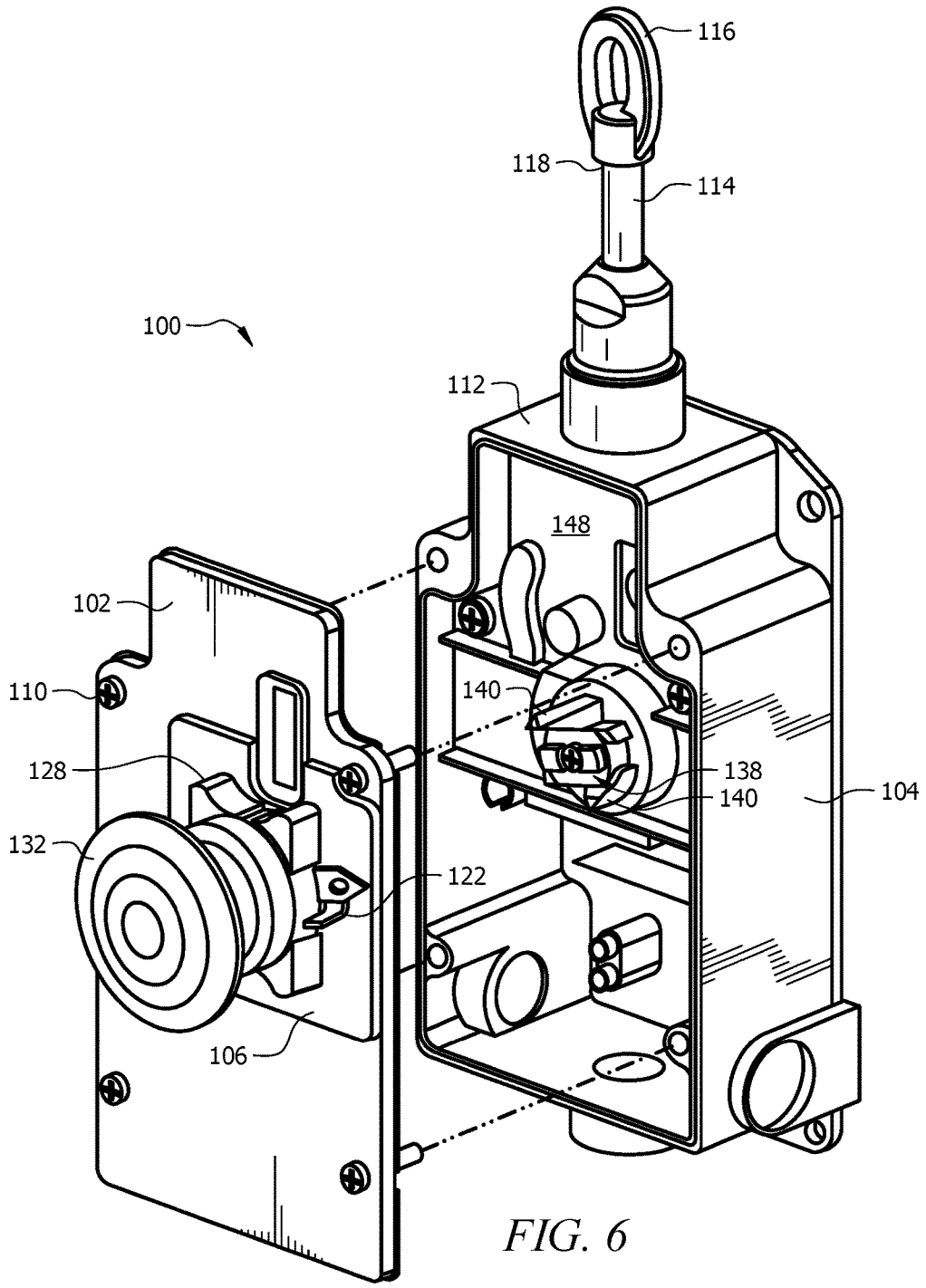
FIG. 6 is a schematic illustration of a mating cam positioned within a housing of an E-stop Pushbutton Safety Switch in accordance with embodiments of the disclosure.

FIG. 6 illustrates mating cam 138 positioned within housing 104. Activation mechanism 148 may include a plunger that may directly contact a mating plunger of an electrical circuit mechanism. Activation mechanism 148 may be positioned within housing 104 and may be coupled to an interior of housing 104 by any suitable means, such as, for example, adhesive, welds, screws, bolts or combinations thereof. Mating cam 138 may be operatively (e.g., electrically and/or mechanically) coupled to activation mechanism 148. Activation mechanism 148 may be operatively (e.g., electrically and/or mechanically) coupled to a machine and may be configured to allow (e.g., activate the electrical circuit mechanism by contacting the mating plunger with the plunger) and terminate (e.g., deactivate the electrical circuit mechanism by separating the plunger from the mating plunger) power to the machine upon rotation of mating cam 138, and/or movement or pulling of the shaft 114 beyond a threshold.

Figure 7B:
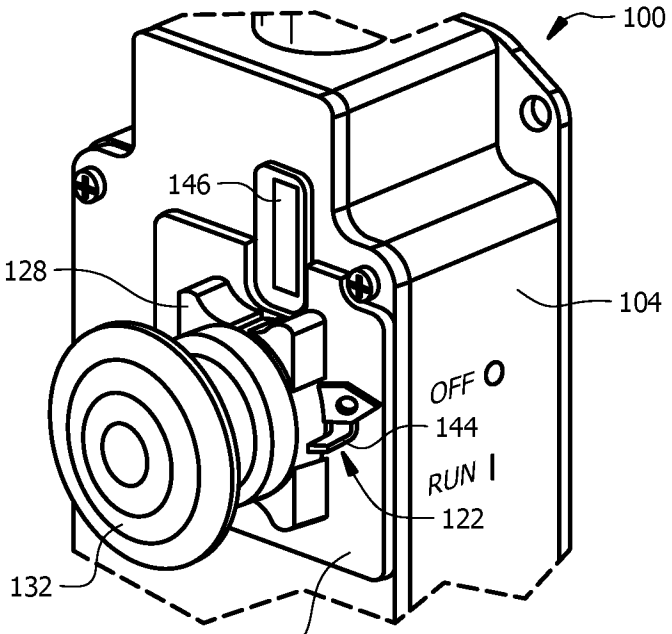
FIGS. 7A and 7B illustrate indicators of operation for an E-stop Pushbutton Safety Switch in accordance with embodiments of the disclosure.
Figure 7A:
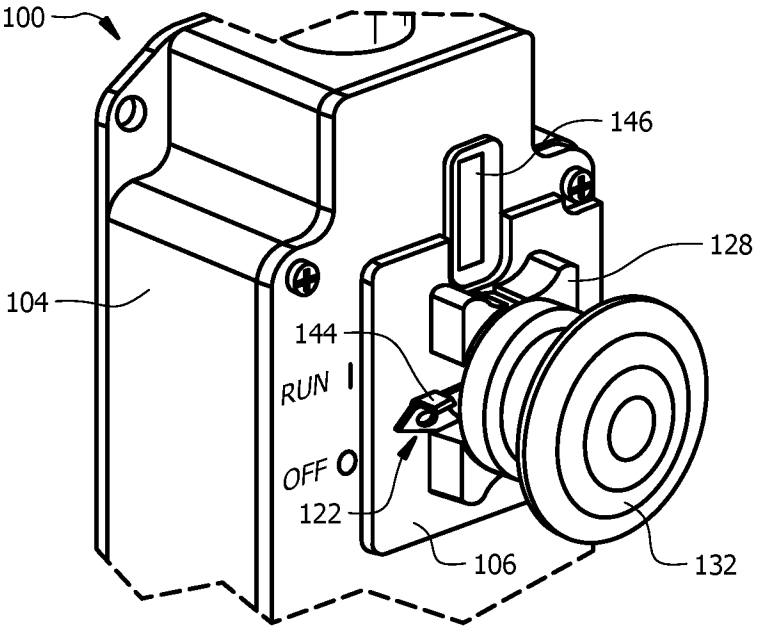

FIGS. 7A and 7B illustrate two positions (modes/indicators of operation) for E-stop Pushbutton Safety Switch 100: RUN ("|") (allowing power to a machine; power-on position) and OFF ("0") (terminating power to a machine; power-off position). Lever 122 may extend from each side of base 128, as shown. Lever 122 may include tabs 144 which may assist a user in moving (e.g., manually) lever 122 to each of the positions mentioned above. Face plate 102 may include a cable tension indicator 146. Cable tension indicator 146 may monitor when a cable is slack, broken and/or pulled.

With reference to FIGS. 1 through 7B, operation of E-stop Pushbutton Safety Switch 100 may be described as follows. A cable may be inserted through eyebolt 116 of E-stop Pushbutton Safety Switch 100 and extend along a perimeter of a machine. Initially, lever 122 of E-stop Pushbutton Safety Switch 100 may be positioned at RUN, thereby allowing power to the machine and causing the machine to operate. A user may pull the cable or depress pushbutton 132 during an emergency to terminate power to the machine. Upon depressing pushbutton 132 (e.g., linear force), cam 126 may move forward, thereby causing protrusions 134 of cam 126 to contact angular surfaces 140 of mating cam 138. As the protrusions 134 press down upon angular surfaces 140, the protrusions 134 may slide against angular surfaces 140, thereby causing mating cam 138 to rotate. This rotation of mating cam 138 may move (rotate) lever 122 to the OFF position, thereby terminating power to the machine via activation mechanism 148. Upon release of pushbutton 132, spring 130 may position pushbutton 132 back to its initial position (not depressed), though this may not cause any rotation of mating cam 138. E-stop Pushbutton Safety Switch 100 may be reset by moving (e.g., manually by a user) lever 122 to RUN. Lever 122 may also be moved to OFF (e.g., manually by a user) in order to terminate power to the machine instead of pulling a cable or depressing pushbutton 132.

Having described various systems and methods, various embodiments can include, but are not limited to:

In a first embodiment, a safety switch may comprise a housing, wherein the housing comprises a mating cam; a face plate, wherein the face plate is coupled to the housing; and a subassembly coupled to the face plate, wherein the subassembly comprises: a base, wherein the base comprises a slot; a cam, wherein the cam is positioned within the base; a pushbutton, wherein the pushbutton comprises a hole; and a pin positioned through the hole of the pushbutton and the slot of the base; wherein the cam, the base, and the pushbutton are mated together with the pin; wherein the subassembly is not rotatable due to the pin.

A second embodiment may include the safety switch of the first embodiment, wherein the safety switch may further comprise a spacer plate, wherein the spacer plate is coupled to the housing; and a retainer positioned within a void of the spacer plate.

A third embodiment may include the safety switch of the first or second embodiment, wherein the safety switch may further comprise a lever coupled to the retainer.

A fourth embodiment may include the safety switch of any of the preceding embodiments, wherein the cam is configured to contact the mating cam.

A fifth embodiment may include the safety switch of any of the preceding embodiments, wherein the safety switch may further comprise a shaft, wherein the shaft extends from the housing, wherein the shaft comprises an eyebolt at a distal end of the shaft.

A sixth embodiment may include the safety switch of any of the preceding embodiments, wherein the mating cam is operatively coupled to an activation mechanism, wherein the activation mechanism is configured to restore and terminate power to a machine.

A seventh embodiment may include the safety switch of any of the preceding embodiments, wherein the mating cam is rotatable and comprises angular surfaces.

An eighth embodiment may include the safety switch of any of the preceding embodiments, wherein the cam comprises protrusions.

A ninth embodiment may include the safety switch of any of the preceding embodiments, wherein the angular surfaces of the mating cam and the protrusions of the cam are configured to convert a linear force into rotary motion.

A tenth embodiment may include the safety switch of any of the preceding embodiments, wherein the safety switch may further comprise indicators of operation, wherein the indicators comprise: allowing power to the machine and terminating power to the machine.

In an eleventh embodiment, a method for operating a safety switch for a cable-pull mechanism may comprise: depressing a pushbutton with a linear force on an emergency stop mechanism of the cable-pull mechanism; moving a cam towards a mating cam, wherein the cam comprises protrusions, wherein the mating cam comprises angular surfaces; contacting the angular surfaces of the mating cam with the protrusions of the cam; sliding the protrusions against the angular surfaces; rotating the mating cam; and terminating power to a machine.

A twelfth embodiment may include the method of the eleventh embodiment, wherein the rotating the mating cam comprises converting the linear force to a rotary motion.

A thirteenth embodiment may include the method of the eleventh or twelfth embodiments, wherein the method may further comprise powering the machine before depressing the pushbutton with the linear force.

A fourteenth embodiment may include the method of any one of the eleventh through thirteenth embodiments, wherein the rotating the cam comprises moving a lever to a power off position.

A fifteenth embodiment may include the method of any one of the eleventh through fourteenth embodiments, wherein the method may further comprise moving the lever to a power-on position.

In a sixteenth embodiment, a safety switch may comprise: a subassembly, wherein the subassembly comprises: a base, wherein the base comprises a slot; a cam, wherein the cam is positioned within the base; a pushbutton, wherein the pushbutton comprises a hole; a spring, wherein the spring is positioned between the base and the pushbutton; and a pin positioned through the hole of the pushbutton and the slot of the base; wherein the cam, the base, and the pushbutton are mated together with the pin; wherein the subassembly is not rotatable due to the pin.

A seventeenth embodiment may include the safety switch of the sixteenth embodiment, wherein the cam is positioned to contact a mating cam.

An eighteenth embodiment may include the safety switch of the sixteenth or seventeenth embodiment, wherein the cam comprises protrusions.

A nineteenth embodiment may include the safety switch of any one of the sixteenth through eighteenth embodiments, wherein the mating cam comprises angular surfaces.

A twentieth embodiment may include the safety switch of any one of the sixteenth through nineteenth embodiments, wherein the cam and the mating cam are configured to convert a linear force to a rotary motion.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A safety switch, comprising:

a housing, wherein the housing comprises a mating cam;

a face plate, wherein the face plate is coupled to the housing;

a subassembly coupled to the face plate, wherein the subassembly comprises:

a base, wherein the base comprises a slot;

a cam, wherein the cam is positioned within the base;

a pushbutton, wherein the pushbutton comprises a hole; and a pin positioned through the hole of the pushbutton and the slot of the base;

wherein the cam, the base, and the pushbutton are mated together with the pin;

wherein the subassembly is not rotatable due to the pin;

a spacer plate coupled to the housing; and a retainer positioned within a void of the spacer plate; and a lever coupled to the retainer.

2. The safety switch of claim 1, wherein the cam is configured to contact the mating cam.

3. The safety switch of claim 2, further comprising a shaft, wherein the shaft extends from the housing, wherein the shaft comprises an eyebolt at a distal end of the shaft.

4. The safety switch of claim 3, wherein the mating cam is operatively coupled to an activation mechanism, wherein the activation mechanism is configured to restore and terminate power to a machine.

5. The safety switch of claim 4, wherein the mating cam is rotatable and comprises angular surfaces.

6. The safety switch of claim 5, wherein the cam comprises protrusions.

7. The safety switch of claim 6, wherein the angular surfaces of the mating cam and the protrusions of the cam are configured to convert a linear force into rotary motion.

8. The safety switch of claim 7, further comprising indicators of operation, wherein the indicators of operation comprise: allowing power to the machine and terminating power to the machine.

9. A safety switch, comprising:

a subassembly, wherein the subassembly comprises:

a base, wherein the base comprises a slot;

a cam, wherein the cam is positioned within the base;

a pushbutton, wherein the pushbutton comprises a hole;

a spring, wherein the spring is positioned between the base and the pushbutton; and a pin positioned through the hole of the pushbutton and the slot of the base;

wherein the cam, the base, and the pushbutton are mated together with the pin;

wherein the subassembly is not rotatable due to the pin;

a spacer plate coupled to the subassembly;

a retainer positioned within a void of the spacer plate; and a lever coupled to the retainer.

10. The subassembly of claim 9, wherein the cam is positioned to contact a mating cam.

11. The subassembly of claim 10, wherein the cam comprises protrusions.

12. The subassembly of claim 11, wherein the mating cam comprises angular surfaces.

13. The subassembly of claim 12, wherein the protrusions of the cam and the angular surfaces of the mating cam are configured to convert a linear force to a rotary motion.

* * * * *